US008490669B2

(12) United States Patent
Fletcher et al.

(10) Patent No.: US 8,490,669 B2
(45) Date of Patent: Jul. 23, 2013

(54) INSULATED TRACKS FOR LOADING DOCK DOORS AND ASSOCIATED METHODS OF MANUFACTURE AND USE

(75) Inventors: John Robson Fletcher, Waukesha, WI (US); Milena Dancheva Vohla, Greendale, WI (US); Carlo G. Mascari, Milwaukee, WI (US)

(73) Assignee: 4Front Engineered Solutions, Inc., Carrollton, TX (US)

( * ) Notice: Subject to any disclaimer, the term of this patent is extended or adjusted under 35 U.S.C. 154(b) by 0 days.

(21) Appl. No.: 13/398,012

(22) Filed: Feb. 16, 2012

(65) Prior Publication Data

US 2012/0211177 A1 Aug. 23, 2012

Related U.S. Application Data

(60) Provisional application No. 61/444,470, filed on Feb. 18, 2011.

(51) Int. Cl.
*E06B 7/16* (2006.01)

(52) U.S. Cl.
USPC ..... 160/40; 160/201

(58) Field of Classification Search
USPC ..... 160/40, 201, 207; 52/2.12; 16/95 R
See application file for complete search history.

(56) References Cited

U.S. PATENT DOCUMENTS

| | | | | |
|---|---|---|---|---|
| 1,787,451 | A | 1/1931 | Mohun et al. | |
| 3,693,693 | A * | 9/1972 | Court | 160/195 |
| D245,266 | S | 8/1977 | Gorse | |
| 4,119,133 | A * | 10/1978 | Wolf | 160/209 |
| 4,452,293 | A | 6/1984 | Gorse | |
| 4,467,853 | A * | 8/1984 | Downey, Jr. | 160/133 |
| 4,643,239 | A * | 2/1987 | Wentzel | 160/201 |
| 4,676,293 | A | 6/1987 | Hanssen | |
| 4,776,379 | A * | 10/1988 | Kraeutler | 160/84.06 |
| 4,880,045 | A | 11/1989 | Stahler | |
| 5,025,847 | A | 6/1991 | Mueller | |
| 5,139,075 | A | 8/1992 | Desrochers | |
| 5,141,043 | A | 8/1992 | Kraeutler | |
| 5,141,044 | A | 8/1992 | Hying et al. | |
| 5,163,494 | A | 11/1992 | MacNeil et al. | |
| 5,165,746 | A * | 11/1992 | Teigen | 296/24.45 |
| 5,219,015 | A | 6/1993 | Kraeutler | |
| 5,222,541 | A | 6/1993 | Hornberger | |
| 5,246,053 | A * | 9/1993 | Kraeutler | 160/84.02 |
| 5,544,690 | A * | 8/1996 | Magro et al. | 160/133 |
| 5,718,276 | A * | 2/1998 | Rekret | 160/201 |
| 5,927,368 | A | 7/1999 | Rohrer et al. | |
| 6,119,307 | A | 9/2000 | Weishar et al. | |
| 6,190,751 | B1 * | 2/2001 | Sylvester | 428/66.4 |
| 6,374,567 | B1 * | 4/2002 | Mullet | 52/716.1 |
| 2010/0319143 | A1 | 12/2010 | Wessel | |

* cited by examiner

*Primary Examiner* — David Purol
(74) *Attorney, Agent, or Firm* — Perkins Coie LLP

(57) ABSTRACT

Insulated tracks for use with loading dock doors are disclosed herein. In one embodiment, an insulated door track configured in accordance with the present disclosure includes a first insulator, such as a plastic material, applied to a surface of the door track that extends adjacent to the loading dock door in the closed position. A second insulator, such as a radiant barrier comprised of a thin film of a reflective material, such as aluminum, can be applied to an opposing surface of the first insulator to prevent or at least reduce radiant energy losses through the track. A gap between the first insulator and the door jamb can be sealed with a third insulator, such as a suitable strip of foam.

21 Claims, 10 Drawing Sheets

INSULATED TRACKS FOR LOADING DOCK DOORS AND ASSOCIATED METHODS OF MANUFACTURE AND USE

CROSS-REFERENCE TO RELATED APPLICATION(S) INCORPORATED BY REFERENCE

The present application claims the benefit of and priority to U.S. Provisional Patent App. No. 61/444,470, filed Feb. 18, 2011, entitled "INSULATED TRACKS FOR LOADING DOCK DOORS AND ASSOCIATED METHODS OF MANUFACTURE AND USE," and incorporated herein by reference in its entirety.

TECHNICAL FIELD

The following disclosure relates generally to loading dock doors and, more particularly, to insulated tracks for loading dock doors.

BACKGROUND

Conventional loading docks typically include an elevated opening in a side of a warehouse or other building. The opening is normally covered by a door, such as an overhead door. To transfer cargo to or from a trailer or other transport vehicle, the doors on the back of the vehicle are opened and the vehicle is backed up to the opening in the building. A vehicle restraint can be employed to hold the vehicle in position in front of the opening. The loading dock door is then raised, and a dock leveler is extended through the opening to provide a ramp from the floor of the building onto the bed of the transport vehicle. Conventional dock levelers typically include a deck that rotates upwardly and away from the floor of the building, and then downwardly as a front lip rotates outwardly. As the deck descends, the lip comes to rest on the bed of the transport vehicle. Once in place, forklifts, workers, etc. can move back and forth over the dock leveler to load and/or unload cargo from the shipping vehicle.

Conventional overhead doors typically include a plurality of rectangular panels pivotally connected together along upper and lower edges. Rollers typically extend outwardly from each side the door panels, and are received in corresponding guide channels on vertical door tracks that extend upwardly along each side of the door opening. Some door tracks extend vertically, or at least generally vertically, above the door opening so that the door is retracted into a generally vertical position when opened. Other overhead door tracks turn horizontally and extend away from the opening so that the door is retracted into a horizontal position above the dock leveler when opened.

It is often desirable to seal and/or insulate warehouses and processing facilities to avoid or at least reduce energy losses. For example, many warehouses are heated during extremely cold weather conditions. If the areas around loading dock doors and dock levelers are not sufficiently sealed and/or insulated, the warehouse can experience significant heat losses. Similarly, refrigerated warehouses can also experience significant energy losses during warm weather conditions if the warehouse is not sufficiently sealed and/or insulated. Although many loading dock openings include exterior seals and/or weather shields to seal between the back end of the shipping trailer and the door opening, these seals do not prevent convective energy losses through gaps around the loading dock doors and/or dock levelers when there is no vehicle present. Moreover, additional energy losses can result from conduction through the door, door track, and dock leveler materials when the door is closed. Accordingly, it would be desirable to reduce energy losses associated with loading dock doors.

DETAILED DESCRIPTION

The present disclosure describes various embodiments of insulated guide tracks for use with loading dock doors. In one embodiment, an insulated door track configured in accordance with the present disclosure includes an arrangement of different insulating materials to insulate the door track against energy losses. For example, the door track can include a first insulating material positioned on an inner surface of a track member between a guide channel and a door jamb. The first insulating material can provide a sliding surface that contacts the seal or seals on the side edges of the adjacent door panels. The first insulating material can be formed from various types of plastic or similar materials. The insulated door track can also include a second insulating material positioned on the back side and outboard edge of the first insulating material. By way of example, the second insulating material can include aluminum foil or a similarly reflective material to provide a radiant barrier. The insulated door track can additionally include a third insulating material sandwiched between the outboard edge of the first insulating material and the door jamb to seal any gaps that may exist between these parts. Such materials can include, for example, a compressible foam strip. The forgoing introductory discussion is meant to provide the reader with a general overview of one embodiment of the disclosure. Accordingly, as described in greater detail below, other embodiments can include other materials and features in other arrangements.

The details set forth in the following description and in FIGS. 1-8 provide a thorough understanding of various embodiments of the disclosure. Other details describing well-known structures and systems often associated with loading docks, loading dock doors, door tracks and other features have not been set forth in the following disclosure to avoid unnecessarily obscuring the description of the various embodiments.

Many of the details, dimensions, angles and other features shown in the Figures are merely illustrative of particular embodiments of the disclosure. Accordingly, other embodiments can have other details, dimensions, angles and features without departing from the spirit or scope of the present invention. In addition, those of ordinary skill in the art will appreciate that further embodiments of the invention can be practiced without several of the details described below.

In the Figures, identical reference numbers identify identical, or at least generally similar, elements. To facilitate the discussion of any particular element, the most significant digit or digits of any reference number refers to the Figure in which that element is first introduced. For example, element 110 is first introduced and discussed with reference to FIG. 1.

Figure 1:
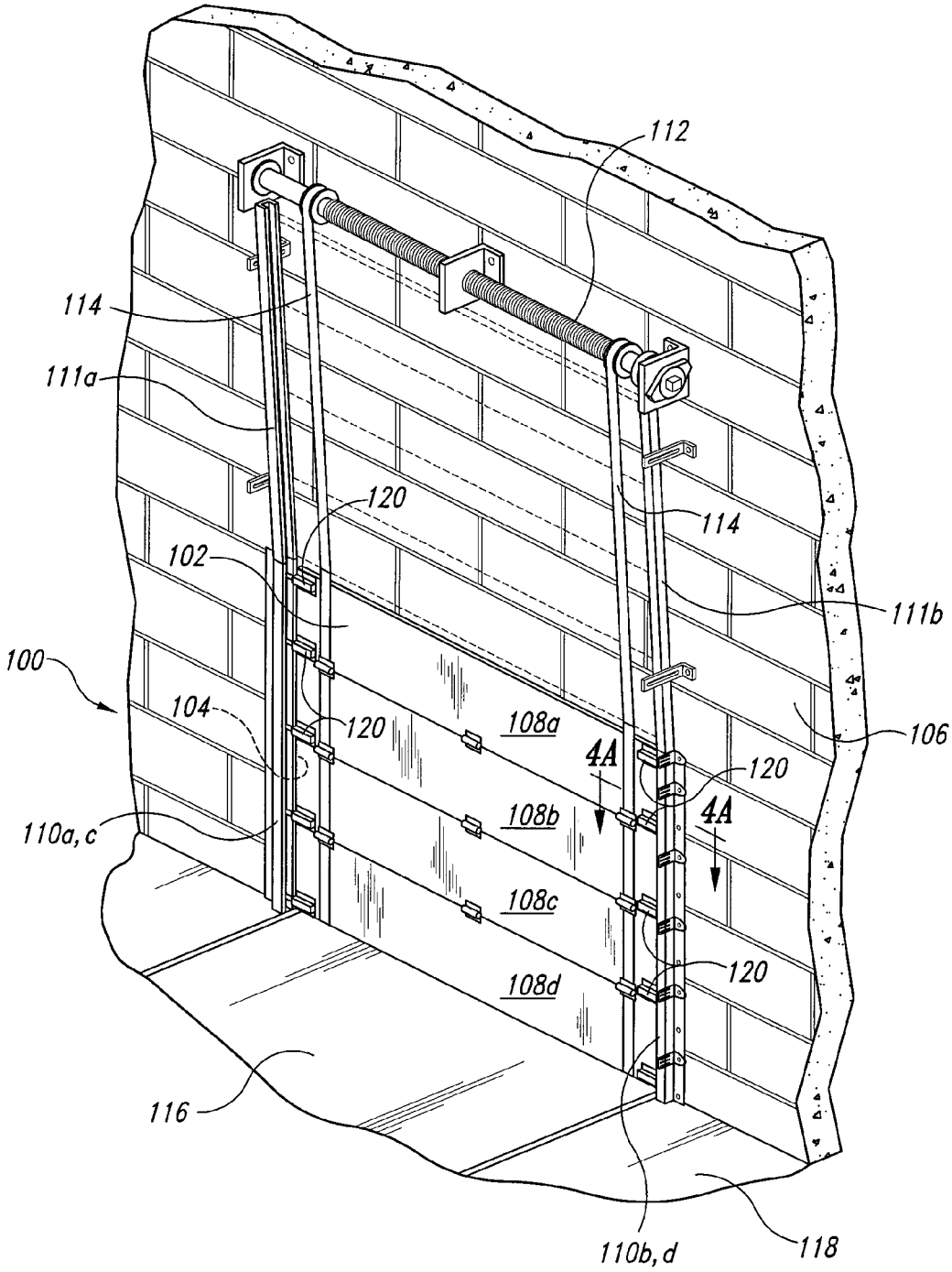
FIG. 1 is an interior isometric view of a loading dock having a door with an insulated track configured in accordance with an embodiment of the disclosure.

FIG. 1 is an interior isometric view of a loading dock door assembly 100 having a first insulated door track 110*a, c* and a second insulated door track 110*b, d* configured in accordance with an embodiment of the disclosure. In the illustrated embodiment, the door assembly 100 is installed adjacent an opening 104 in a warehouse or other building 106. A dock leveler 116 is operably mounted in a pit formed in a floor 118 of the building 106 adjacent to the opening 104. The door assembly 100 can include an overhead door 102 having a plurality of panels 108 (identified individually as door panels 108*a-d*) pivotally coupled together in a conventional manner. The door 102 can further include a plurality of guide members assemblies 120 extending outwardly from opposing side edges thereof. Each of the guide member assemblies 120 can include a roller, plunger, or similar device that is movably received in a corresponding guide channel in the adjacent insulated door track 110.

The insulated door tracks 110 ("door tracks 110") are attached to the building 106 along opposite sides of the door opening 104. In the illustrated embodiment, each of the door tracks 110 includes a segment (identified as a first track extension 111*a* and a second track extension 111*b*) that extends vertically, or at least generally vertically, above the opening 104 to receive the door 102 in the raised or open position. In other embodiments, however, each of the door tracks 110 can include a segment that turns away from the building wall above the door opening 104 to receive the door 102 in a horizontal position when opened. Accordingly, as those of ordinary skill in the art will appreciate, the insulated door tracks disclosed herein are not limited to use with vertically-storing overhead doors, but can be used with virtually any type of overhead dock door known in the art, including vertically and horizontally stored dock doors.

In the illustrated embodiment, only the portions of the door tracks 110 positioned adjacent to or near the opening 104 are insulated. The track extensions 111, for example, can be left uninsulated. The reason for this is that it may not be cost effective to insulate portions of the door tracks 110 that are spaced apart from the opening 104 because these portions are generally not conducive to energy losses. In other embodiments, however, all or other portions of the door tracks 110 can be insulated if desired.

A conventional counterbalance assembly 112 can be positioned above the opening 104 and operably coupled to the door 102 by one or more cables 114. The cables 114 can be operably wound about spring-biased drums to assist manual lifting of the door 102 away from the opening 104. In other embodiments, the door assembly 100 can additionally include an automatic door opening system. Once the door 102 has been raised, the dock leveler 116 can be employed in a conventional manner to extend between the floor 118 and the bed of the trailer or other shipping vehicle (not shown) parked in front of the opening 104.

Figure 2:
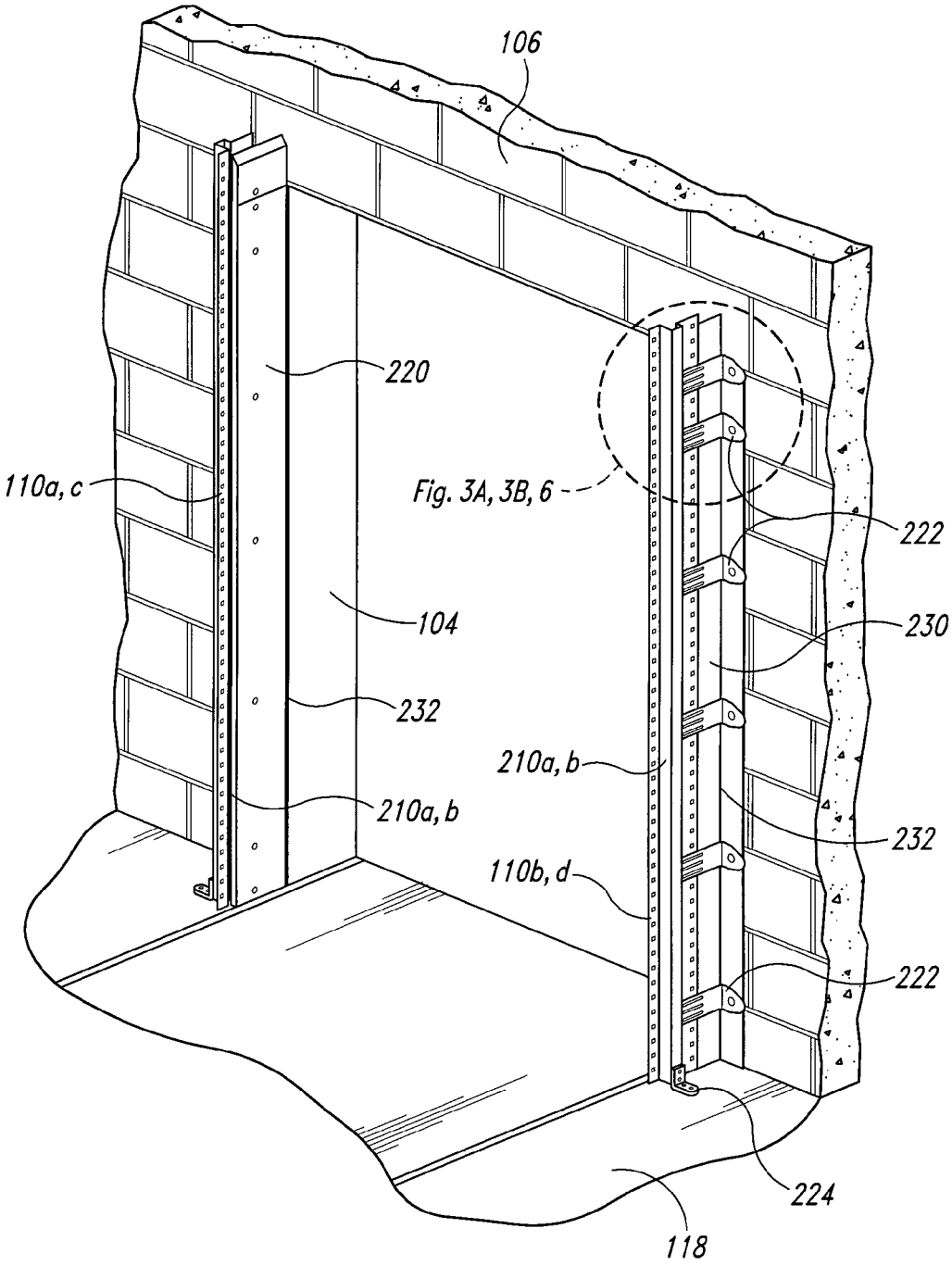
FIG. 2 is an interior isometric view of the loading dock of FIG. 1 with the dock door removed for purposes of the illustration.

FIG. 2 is an interior isometric view of the door assembly 100 of FIG. 1 with the door 102 and the upper portions of the door tracks 110 removed for purposes of illustration. Each door track 110 includes an elongate track member 210*a, b* having a guide channel that movably receives the guide members extending from the guide member assemblies 120 (FIG. 1). More specifically, the embodiment of the door assembly 100 that includes the first door track 110*a* and the second door track 110*b* utilizes the first track member 210*a*, and the embodiment of the door assembly 100 that includes the third door track 110*c* and the fourth track 110*d* utilizes the second track member 210*b*. As described in greater detail below, the first track member 210*a* and the second track member 210*b* differ somewhat in, for example, how they are mounted to the corresponding door jamb. The track members 210*a*, for example, are fixedly attached to the building 106 alongside the door opening 104 by a plurality of mounting brackets 222, whereas the track members 210*b* can be fixedly attached to the building 106 with or without the mounting brackets 222, depending on the applicable strength requirements. A lower mounting bracket 224 can additionally be used to secure the bottom end of each track member 210 to the floor 118.

As described in greater detail below, each door track 110 can include an elongate strip or piece of a first insulating material or first insulator 220 attached to an inner surface of the track member 210. As used herein, the term "inner surface" of the track member 210 refers to the surface that faces the opposing track member 210 on the opposite side of the door opening 104. The first insulator 220 can provide a sliding contact surface for a seal or seals mounted to the side edges of the door panels 108 (FIG. 1). Each door track 110 can additionally include a second insulating material or second insulator 230 applied or otherwise affixed to an outer surface of the first insulator 220. As used herein, the term "outer surface" of the first insulator 220 refers to the surface that faces away from the opposing track member 210 on the opposite side of the door opening 104. Additionally, a third insulating material or third insulator 232 can be installed between an outboard edge of the first insulator 220 and the adjacent door jamb to seal a gap in this area. Various aspects and features of the first insulator 220, the second insulator 230, and the third insulator 232 are described in greater detail below with reference to FIGS. 3A-5.

Figure 3A:
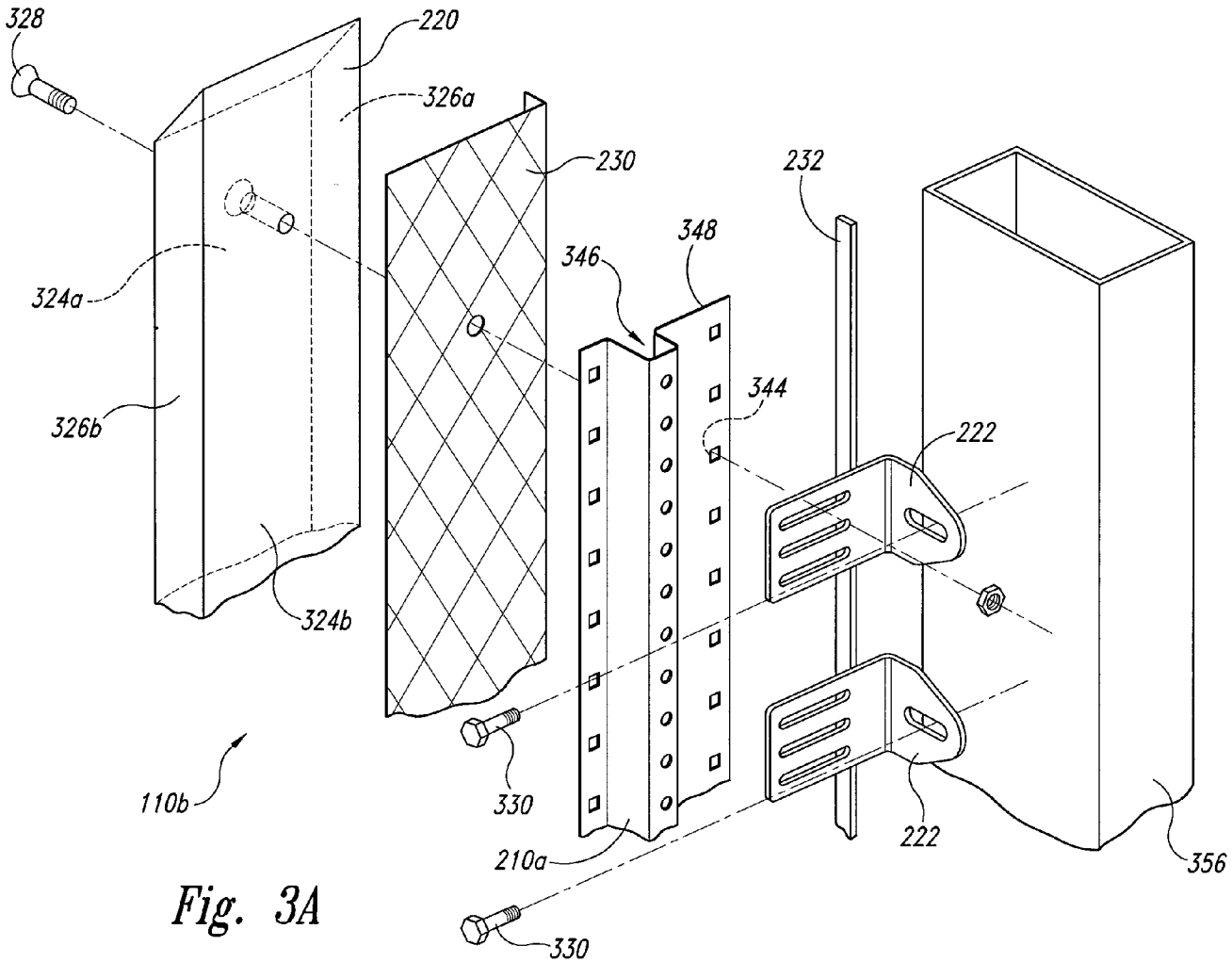
FIG. 3A is an exploded isometric view.
Figure 3B:
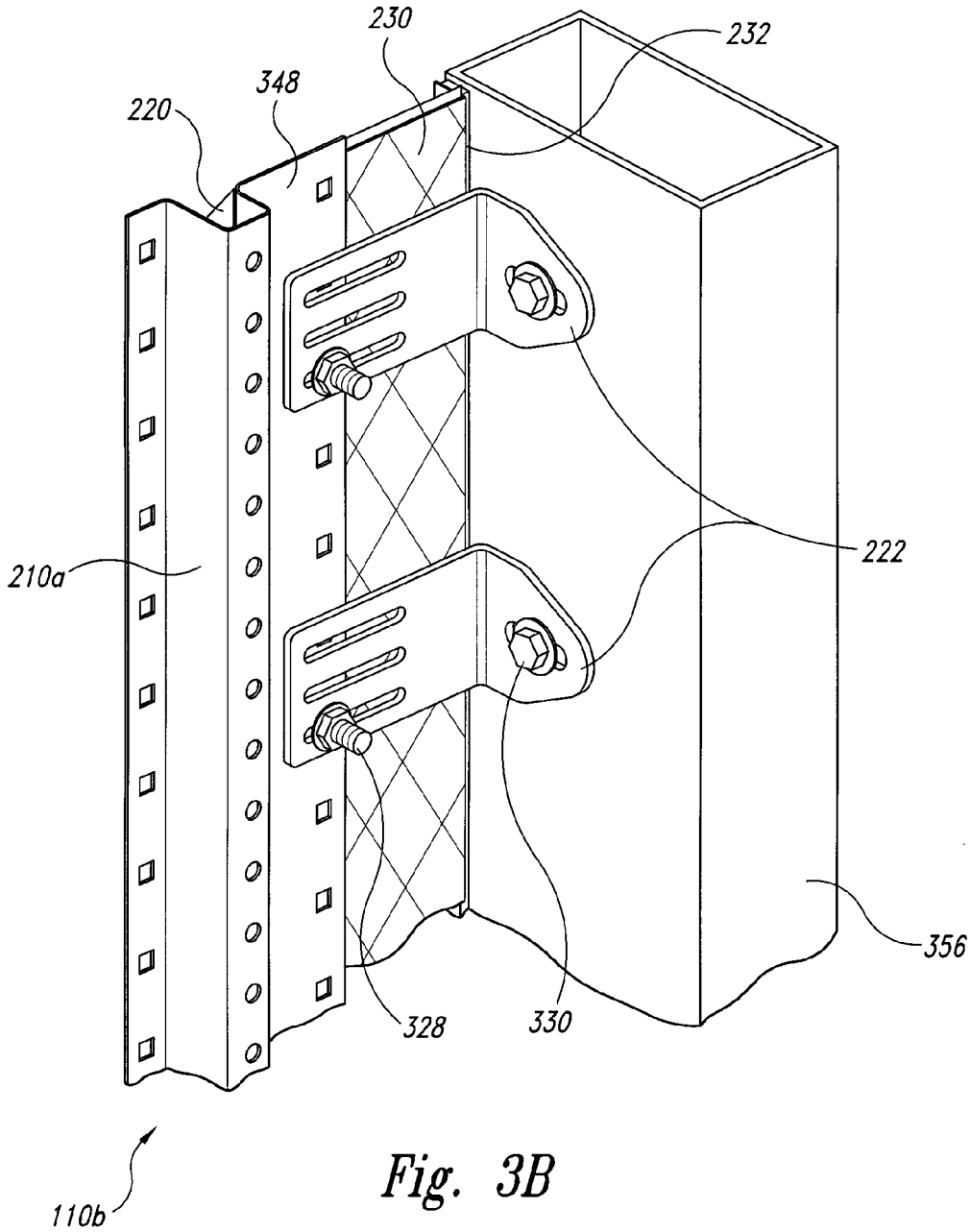
FIG. 3B is an assembled isometric view, of an insulated door track configured in accordance with an embodiment of the disclosure.

FIG. 3A is an exploded isometric view of a portion of the second insulated door track 110*b* configured in accordance with an embodiment of the disclosure, and FIG. 3B is an assembled isometric view of the portion of door track shown in FIG. 3A. For ease of reference, this portion of the second door track 110*b* will be referred to herein as the "door track 110" with the understanding that the first and second door tracks 110*a* and 110*b*, respectively, (as well as the third and fourth door tracks 110*c* and 110*d*, respectively) are essentially mirror images of each other and share the same construction. Referring to FIGS. 3A and 3B together, the track member 210*a* includes a mounting flange 348 adjacent to a guide channel 346. The track member 210*a* can be formed from suitable materials (e.g. sheet metal) using various methods known in the art. In the illustrated embodiment, the first insulator 220 has a generally rectangular cross-sectional shape with an inner surface 324*a* facing toward the door opening 104 (FIG. 1) and an outer surface 324*b* facing away from the opening 104. The first insulator 220 further includes an outboard edge surface 326*a* facing toward a door jamb 356 and an inboard edge surface 326*b* facing toward the interior of the building 106.

To assemble the door track 110, the second insulator 230 is attached or otherwise applied to the outer surface 324*b* and outboard edge surface 326*a* of the first insulator 220. The first insulator 220 is then positioned against an inner surface 344 of the track member flange 348 so that a portion of the second insulator 230 is sandwiched between the first insulator 220 and the flange 348. Suitable fasteners 328 (e.g., threaded bolts, screws, etc.) are installed through corresponding holes in the first insulator 220, the second insulator 230, the track member flange 348, and the brackets 222 to secure the first insulator 220 to the track member 210*a* and the brackets 222. Additional fasteners 328 can also be installed through holes in the first insulator 220, the second insulator 230, and the track member flange 348 in locations spaced apart from the brackets 222 to secure the first insulator 220 to the track member 210*a* in those areas. The third insulator 232 is applied to the portion of the second insulator 230 that covers the outboard edge surface 326*a* of the first insulator 220, and then the assembled door track 110 is positioned against the door jamb 356 and attached thereto with suitable fasteners 330 (e.g., self tapping screws, bolts, concrete anchors, etc.) that are selected based on the type of door jamb material. In some embodiments, for example, the door jamb 356 can be composed of metal, while in other embodiments the door jamb can be composed of concrete, wood, and/or other suitable building materials known in the art.

Figure 4A:
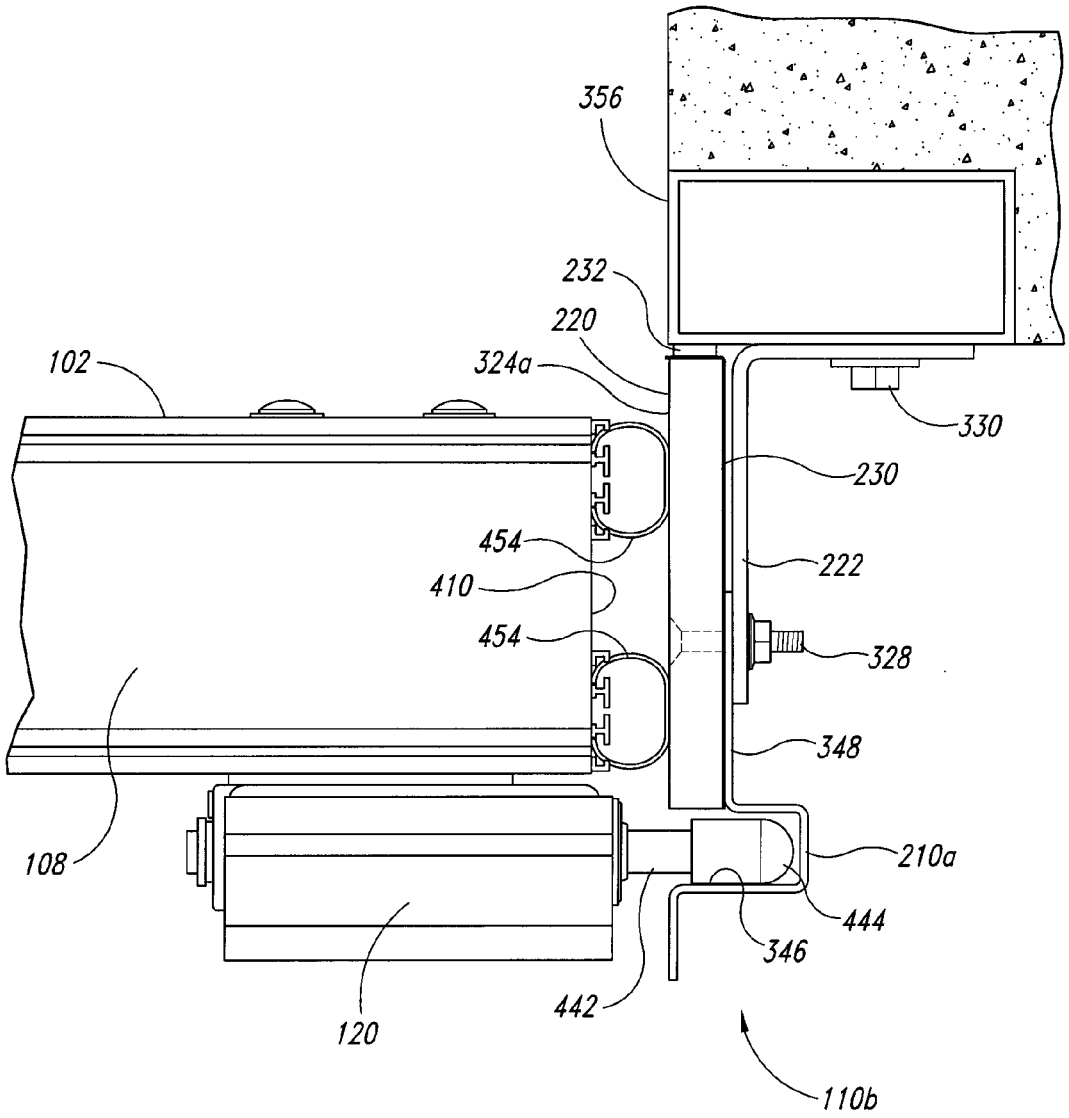
FIG. 4A is a cross-sectional end view of a loading dock door installed in the insulated track of FIGS. 3A and 3B.
Figure 4B:
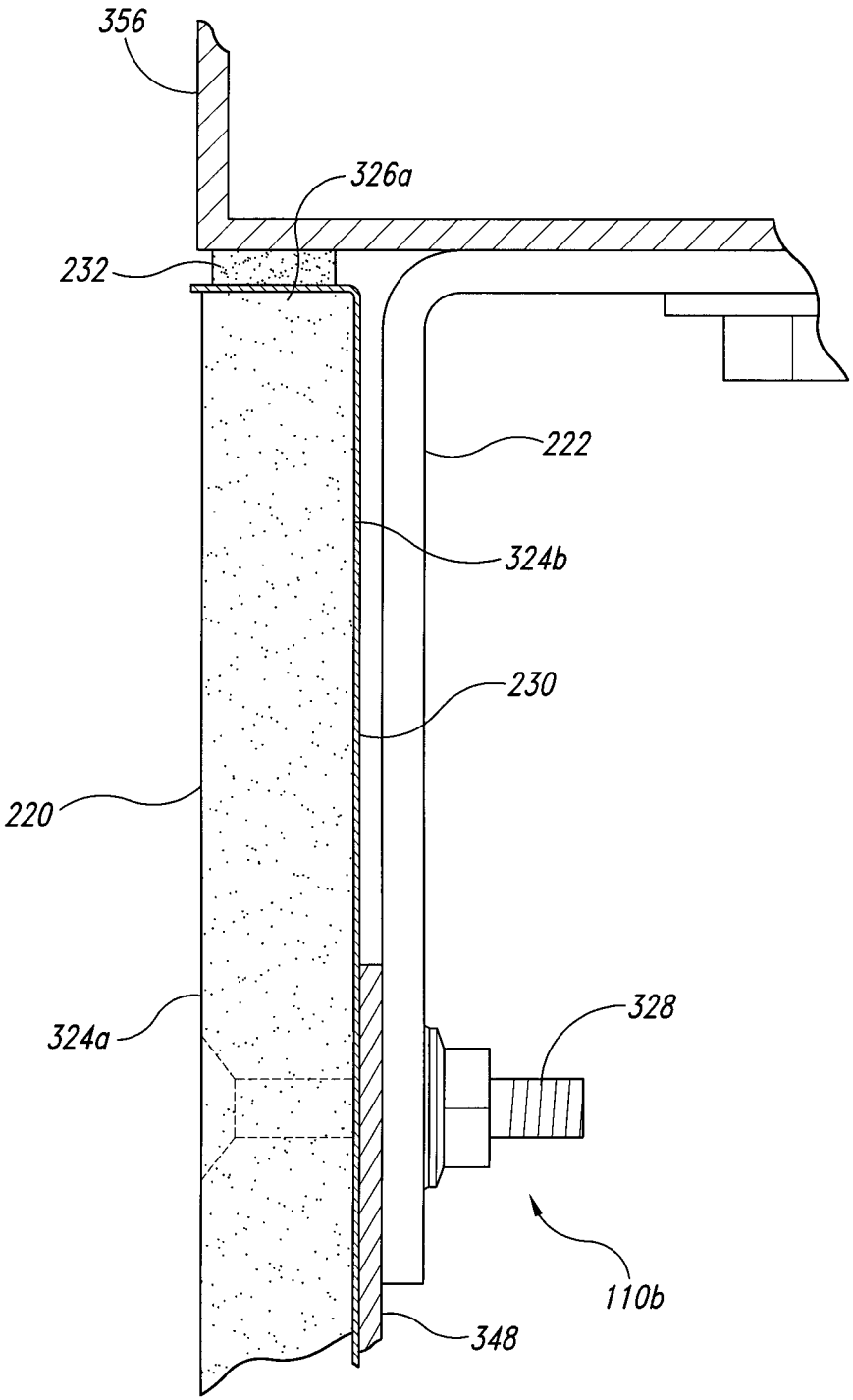
FIG. 4B is an enlarged portion of the cross-sectional end view shown in FIG. 4A.

FIG. 4A is a cross-sectional end view of the door track 110*b* and the door 102 taken along lines 4A-4A in FIG. 1, and FIG. 4B is an enlarged view of a portion of FIG. 4A illustrating various features of the door track 110*b* in more detail. Referring to FIGS. 4A and 4B together, the guide member assembly 120 includes a guide member 442 (e.g., a cylindrical roller or plunger) that protrudes outwardly from a side edge 410 of the door panel 108. The guide member 442 can include a rounded tip or head portion 444 that is movably received in the guide channel 346 to guide the door panel 108 as the door 102 is raised or lowered into position. One or more seals 454 (e.g., compressible bulb seals) are attached to the side edge 410 of the door panel 108 and slidably contact the inner surface 324*a* of the first insulator 220 to seal the gap therebetween. In the illustrated embodiment, the second insulator 230 covers the outer surface 324*b* and the outboard edge surface 326*a* of the first insulator 220. The third insulator 232 is sandwiched between the door jamb 356 and the portion of the second insulator 230 on the outboard edge surface 326*a* of the first insulator 220 to seal the gap therebetween.

Various types of materials having various shapes, sizes, thicknesses and/or composition can be used as the first insulator 220, the second insulator 230, and/or the third insulator 232. In the illustrated embodiment, for example, the first insulator 220 can be a plastic material, such as thermoplastic material, such as High Density Polyethylene (HDPE) material having a thickness of from about 0.12 inch to about 1 inch, or from about 0.25 inch to about 0.75 inch, or about 0.625 inch. The HDPE material provides a durable surface that is impervious or at least substantially impervious to water and can provide relatively high insulating properties. In other embodiments, the first insulator 220 can be formed from and/or can include one or more other materials having suitable insulating properties, durability, or other characteristics, such as thermoset materials, polyurethane, etc.

In the illustrated embodiment, the second insulator 230 can include a thin sheet or layer of reflective material that serves as a radiant barrier to prevent or at least reduce radiant energy losses through the door track 110. For example, in the illustrated embodiment the second insulator 230 can include aluminum foil having a thickness of from about 0.001 inch to about 0.002 inch, or about 0.0014 inch (about 1.4 mil). The aluminum foil can be two-sided reflecting, 99.4 percent aluminum foil reinforced with a scrim, such as polyester or nylon scrim. One source for this type of material is Advanced Technology, Inc. of 3930 Glade Road, Colleyville, Tex. 76034. The second insulator 230 can be adhesively secured to the outer surface 324*b* of the first insulator 220 by means of a suitable adhesive, such as an acrylic adhesive from 3M, such as Scotch 465 hand dispensed "glue-on-a-roll," available from McMaster-Carr.

In the illustrated embodiment, the third insulator 232 can be comprised of an elongate strip of compressible material, such as a suitable foam material. For example, the third insulator 232 can be comprised of closed cell vinyl/Buna-N foam rubber having a thickness of from about 0.12 inch to about 0.6 inch, or about 0.25 inch. The foam material can have a width of from about 0.25 inch to about 1 inch, or about 0.5 inch. The third insulator 232 can be bonded to the second insulator 230 (which is in turn bonded to the first insulator 220) with a suitable adhesive, such as an adhesive-back strip comprising a suitable acrylic adhesive. The adhesive can be applied to the mating surface of the second insulator 230 and not to the door jamb 356, so that the third insulator 232 is compressed against the door jamb 356 during installation of the door track 110*b*.

The foregoing examples illustrate only some of the materials the can be used for the first insulator 220, the second insulator 230, and/or the third insulator 232. Accordingly, as those of ordinary skill in the art will appreciate, in other embodiments these insulators can be formed from and/or can include other suitable materials. In still further embodiments, one or more of the first insulator 220, the second insulator 230, and/or the third insulator 232 can be omitted.

Figure 5:
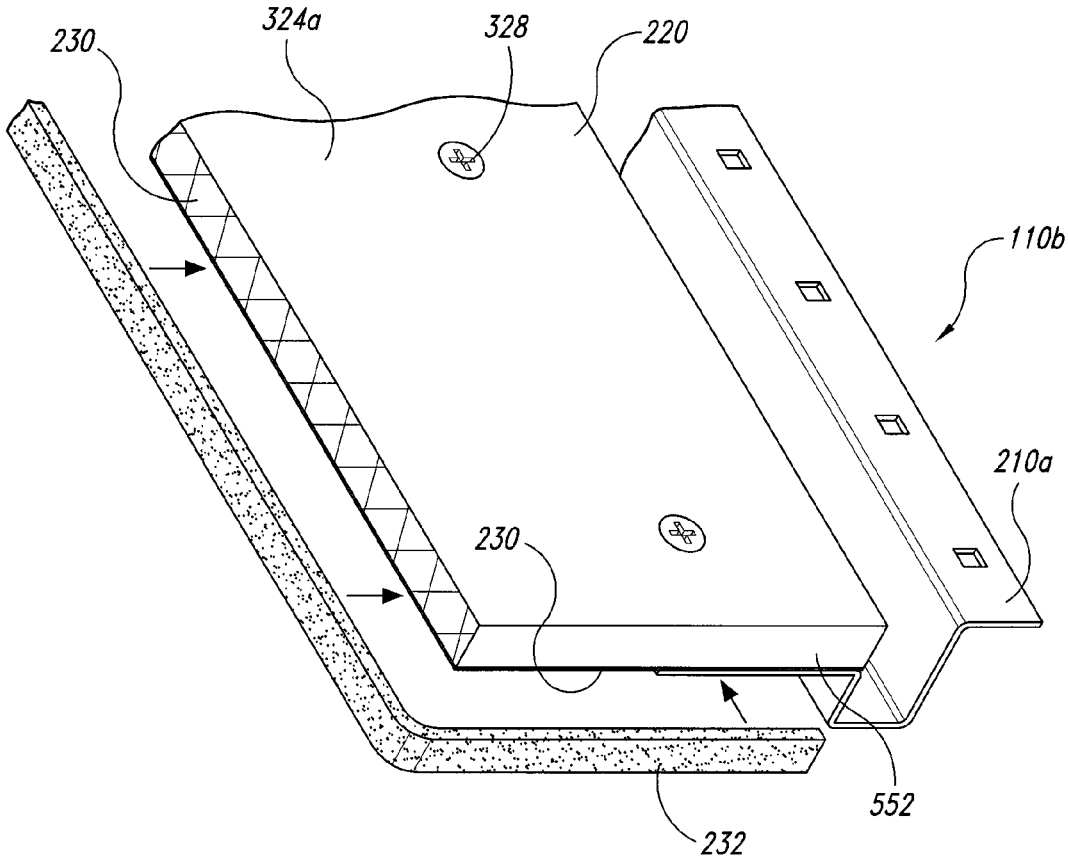
FIG. 5 is a partially exploded, bottom isometric view of a portion of an insulated door track configured in accordance with another embodiment of the disclosure.

FIG. 5 is a partially exploded, bottom isometric view of a lower portion of the door track 110*b* illustrating attachment of the third insulator 232 to a bottom edge surface 552 of the first insulator 220. Applying the third insulator 232 along the bottom edge surface 552 can provide an efficient seal between the first insulator 220 and the floor 118 (FIG. 1) to prevent or at least reduce energy losses through any gaps therebetween.

Figure 6:
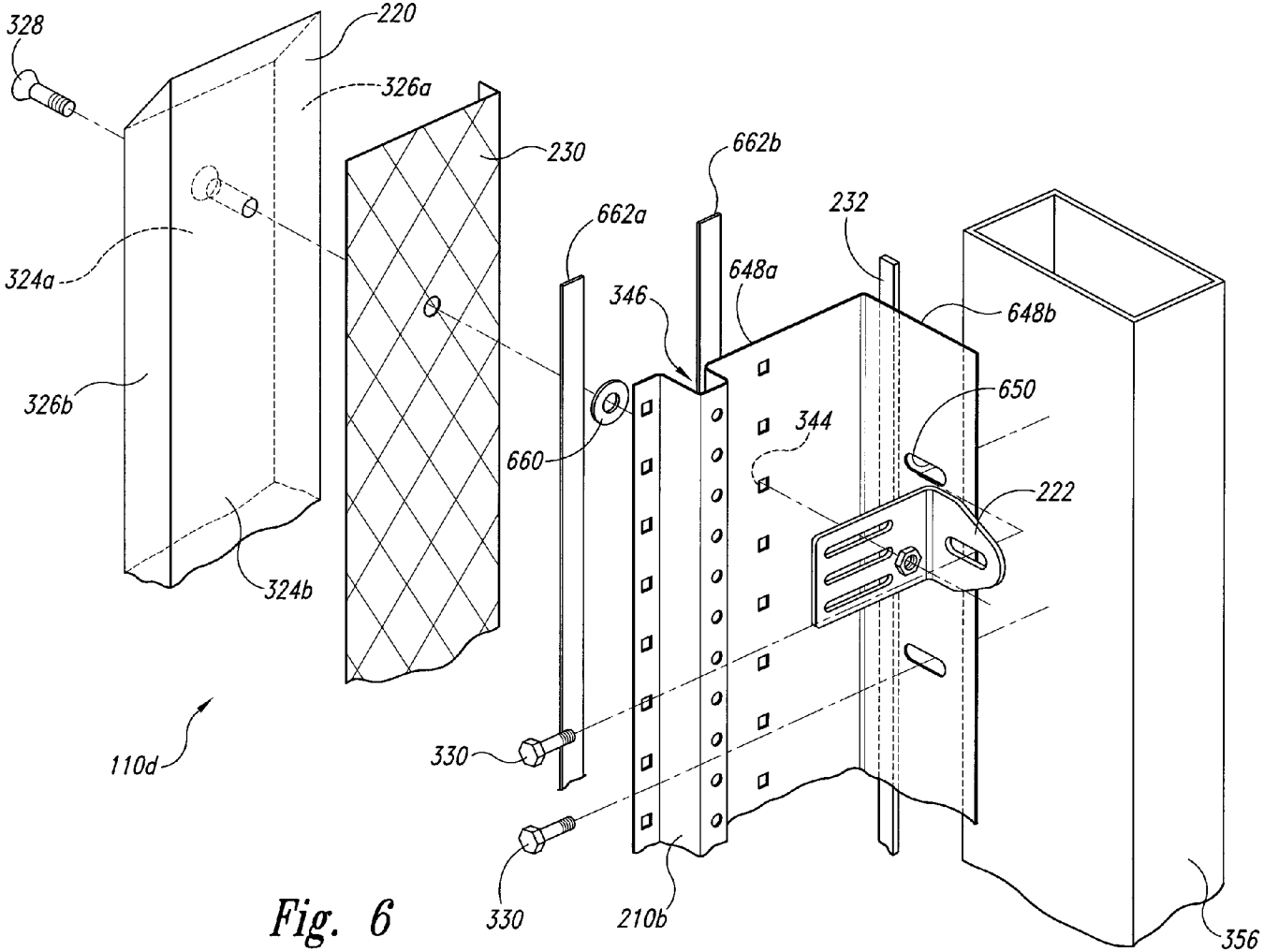
FIG. 6 is an exploded isometric view of an insulated door track configured in accordance with another embodiment of the disclosure.
Figure 7:
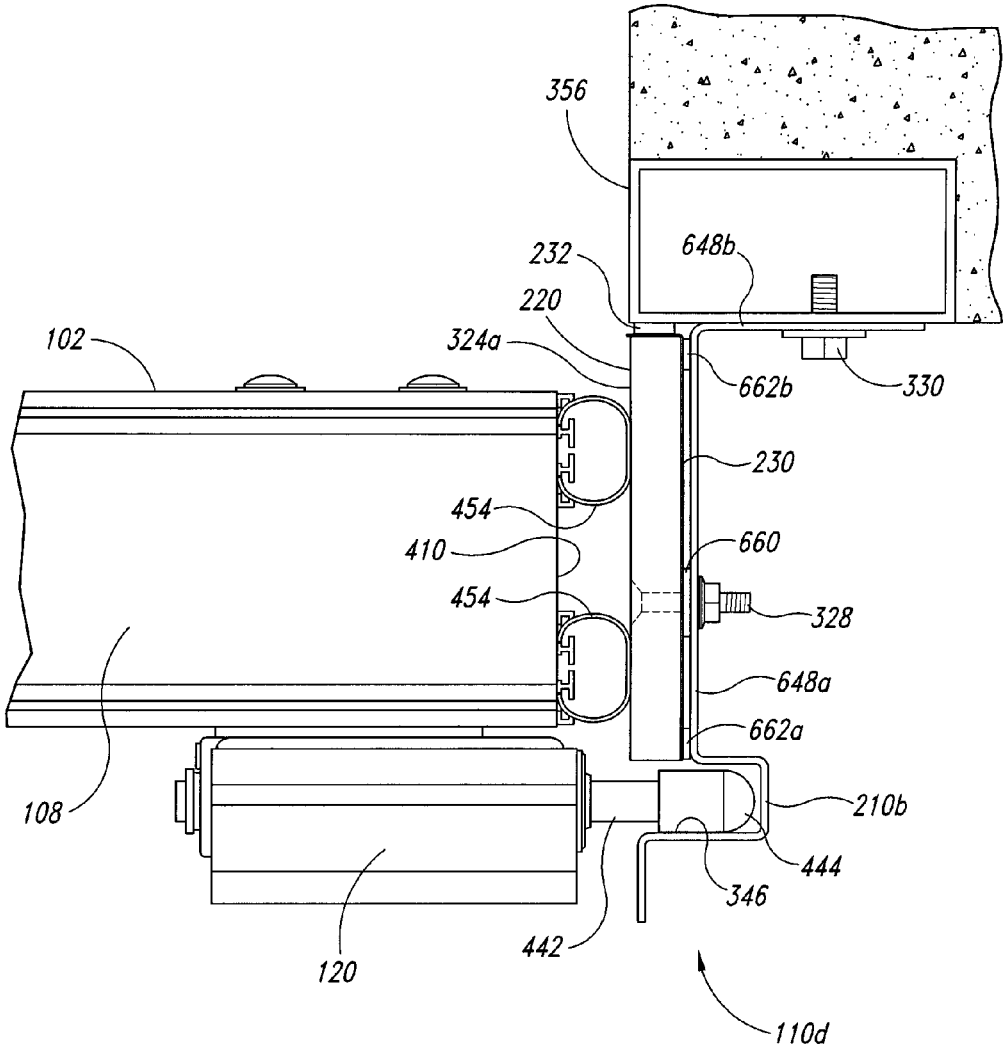
FIG. 7 is a cross-sectional end view of a loading dock door installed in the insulated track of FIG. 6.

FIG. 6 is an exploded isometric view of a portion of the fourth insulated door track 110*d*, configured in accordance with another embodiment of the disclosure. FIG. 7 is a cross-sectional end view of the door track 110*d* illustrating various features of the second track member 210*b* in more detail. Referring to FIGS. 6 and 7 together, the fourth door track 110*d* ("door track 110*d*") is generally similar in structure and function to the second door track 110*b* described above with reference to FIG. 3A and, accordingly, can include many of the same components and features. In the illustrated embodiment, however, the door track 110*d* includes the second track member 210*b* instead of the first track member 210*a*. The second track member 210*b* differs from the first track member 210*a* in that it includes a first flange portion 648*a* that extends toward the door jamb 356 and a second flange portion 648*b* that mates against the door jamb 356.

In the illustrated embodiment, the second flange portion 648*b* can include a series of apertures 650 (e.g., slots or elongated or oval-shaped holes) through which the fasteners 330 extend to mount the door track 110*d* to the door jamb 356. In addition, the door track 110*d* can also be reinforced by installing one or more of the mounting brackets 222 against the track member 210*b* and inserting the fasteners 330 through the mounting brackets 222, the second flange portion 648*b*, and the door jamb 356. This mounting arrangement can reinforce the door track 110*d* and improve its ability to absorb repeated impacts from, e.g., trailer doors and other objects during operation use without sustaining permanent deformation or damage. In other embodiments that may not be exposed to high loads from, e.g., trailer doors and other impacts, some or all the mounting brackets 222 can be omitted, and the door track 110*d* can be mounted directly to the door jamb 356 by installing the fasteners 330 through the second flange portion 648*b* and the door jamb 356.

In one aspect of this embodiment, the door track 110*d* further includes a spacer or stand-off member, such as a washer 660 disposed around the fastener 328 between the third insulator 230 and the first flange portion 648*a*. The washer 660 acts as a spacer to create a gap between the first flange portion 648*a* and the third insulator 230. When the third insulator 230 is, for example, a thin metallic layer that serves as a "radiant barrier," this gap can eliminate or at least reduce conductive energy loses between the track member 210*b* and the third insulator 230.

In another aspect of this embodiment, the door track 110*d* further includes a first seal 662*a* and a second seal 662*b* positioned against the third insulator 230 on the outer surface 324*b* of the first insulator 220. The first seal 662*a* is positioned toward the inboard edge surface 326*b* of the first insulator 220, and the second seal 662*b* is positioned toward the outer edge surface 326*a* of the first insulator 220. In the illustrated embodiment, the seals 662 can be elongate tape strips that are adhered to the third insulator 230 and extend the length of the first insulator 220. Such strips can include, for example, compressible foam strips, such as closed-cell vinyl foam tape that forms a seal between the third insulator 230 and the first flange portion 648*a* of the track member 210*b* when compressed therebetween. The seals 662 can reduce convective energy losses through the gap between the first flange portion 648*a* and the third insulator 230.

Figure 8:
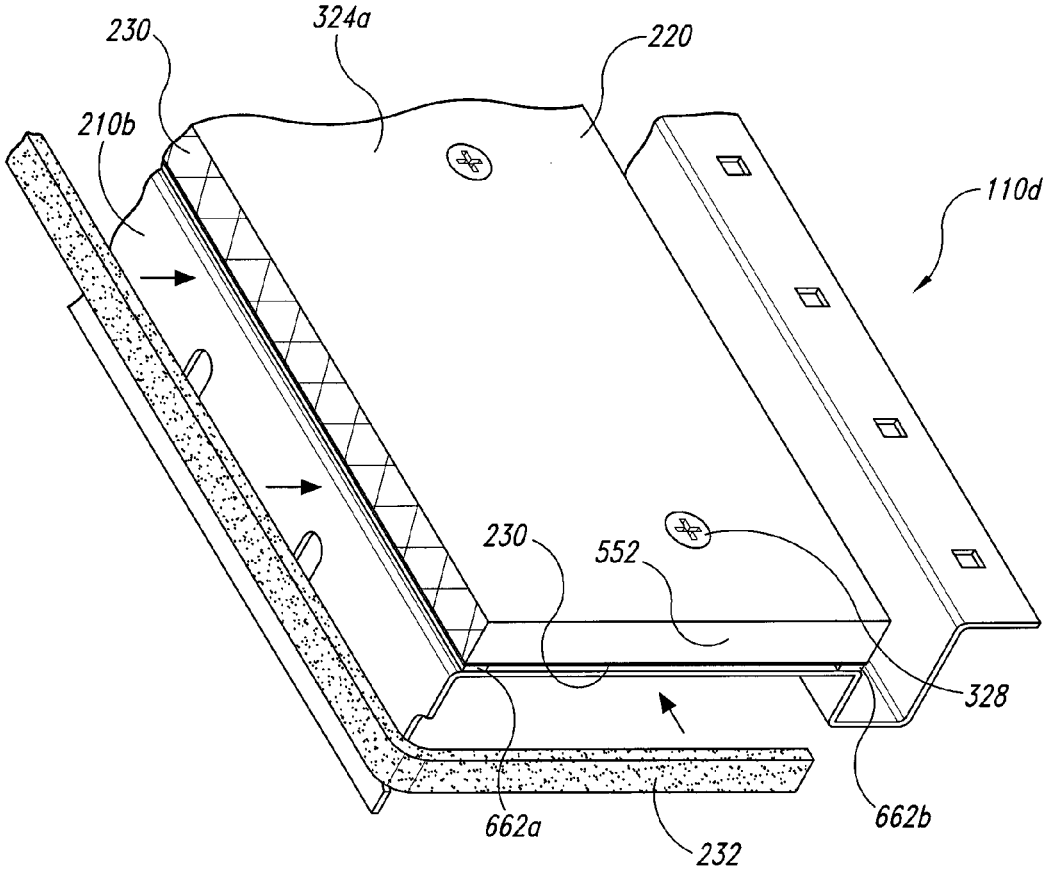
FIG. 8 is a partially exploded, bottom isometric view of a portion of the insulated door track of FIGS. 6 and 7 configured in accordance with another embodiment of the disclosure.

FIG. 8 is a partially exploded, bottom isometric view of a lower portion of the door track 110*d* illustrating attachment of the third insulator 232 to the bottom edge surface 552 of the first insulator 220. Applying the third insulator 232 along the bottom edge surface 552 can provide an efficient seal between the first insulator 220 and the floor 118 (FIG. 1) to prevent or at least reduce energy losses through any gaps therebetween.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

We claim:

1. An insulated door assembly for use with a door opening in a loading dock, the door assembly comprising:

a door having a guide member extending outwardly proximate an edge portion thereof;

a door track mounted to a door iamb along one side of the door opening, the door track having a guide channel that movably receives the guide member and guides the door between opened and closed positions;

a first insulating material carried by the door track between the guide channel and the door jamb, wherein the first insulating material extends along the door track from a first position proximate a lower portion of the door opening to a second position proximate an upper portion of the door opening, and wherein the edge portion of the door is positioned toward a first surface of the first insulating material;

a second insulating material, different than the first insulating material, positioned toward a second surface of the first insulating material opposite the first surface; and one or more spacers installed between the second insulating material and the door track to define a gap therebetween.

2. The door assembly of claim 1 wherein the first insulating material is disposed between the edge portion of the door and the door track when the door is in the closed position.

3. The door assembly of claim 1 wherein the first insulating material is disposed between the guide channel and the door jamb.

4. The door assembly of claim 1, further comprising a seal mounted to the edge portion of the door, wherein the seal slideably contacts the first insulating material as the door moves between the opened and closed positions.

5. The door assembly of claim 1 wherein the door track extends along a vertical edge of the opening, and wherein the first insulating material extends the length of the vertical edge.

6. The door assembly of claim 1 wherein the second insulating material is a thin layer of reflective material covering the second surface of the first insulating material.

7. The door assembly of claim 1 wherein the second insulating material comprises a radiant barrier.

8. The door assembly of claim 1, further comprising:

a first seal disposed in the gap between the second insulating material and the door track and positioned toward the guide track; and a second seal disposed in the gap between the second insulating material and the door track and positioned toward the door jamb.

9. The door assembly of claim 1, further comprising a third insulating material sealing a gap between an edge portion of the first insulating material and the door jamb.

10. The door assembly of claim 1, further comprising:

a compressible seal disposed between an edge portion of the first insulating material and the door jamb.

11. The door assembly of claim 1 wherein the first insulating material is a plastic material having a thickness from about 0.12 inch to about 1 inch.

12. An insulated door assembly for use with a door opening in a loading dock, the door assembly comprising:

a door having an edge portion;

a compressible door seal mounted to the edge portion of the door;

a door track mounted to a door jamb along one side of the door opening, the door track guiding the door as it moves between opened and closed positions;

a first insulating material carried by the door track and disposed between the door track and the door seal when the door is in a closed position, wherein the first insulating material insulates the door assembly against conductive heat transfer;

a second insulating material carried by the door track adjacent to the first insulating material, wherein the second insulating material insulates the door assembly against radiant heat transfer, and wherein the door seal is positioned toward a first side of the first insulating material and the second insulating material is positioned toward a second side of the first insulating material opposite the door seal; and one or more spacers installed between the second insulating material and the door track to define a gap therebetween.

13. The door assembly of claim 12 wherein the door includes a guide member extending outwardly proximate the edge portion thereof, wherein the door track includes a guide channel that movably receives the guide member and guides the door between the opened and closed positions, and wherein the first insulating material is positioned between the guide channel and the door jamb.

14. The door assembly of claim 12 wherein the door seal contacts a first surface of the first insulating material when the door is in the closed position, and wherein the second insulating material is attached to a second surface of the first insulating material, opposite the first surface.

15. The door assembly of claim 12 wherein the first insulating material includes an edge surface facing the door jamb, and wherein the door assembly further comprises a third insulating material filling a gap between the edge surface and the door jamb.

16. The door assembly of claim 12 wherein the first insulating material includes a polyurethane material.

17. The door assembly of claim 12 wherein the first insulating material includes a thermoplastic material.

18. A method of insulating a loading dock door assembly, the door assembly including a door having an edge portion movably engaged with a door track extending adjacent to a door opening, the method comprising:

covering a portion of the door track with a first insulating material from proximate a lower portion of the door opening to proximate an upper portion of the door opening, wherein the first insulating material is positioned between the edge portion of the door and the door track when the door is in a closed position;

overlaying a portion of the first insulating material with a second insulating material from proximate the lower portion of the door opening to proximate the upper portion of the door opening, the second insulating material including a reflective surface; and installing one or more spacers between the second insulating material and the door track to define a gap therebetween.

19. The method of claim 18 wherein covering a portion of the door track with a first insulating material includes covering the portion of the door track with insulating material that inhibits thermal conductivity, and wherein overlaying a portion of the first insulating material with a second insulating material includes the first insulating material with a thin layer of reflective material that inhibits thermal radiation.

20. The method of claim 18 wherein covering a portion of the door track with a first insulating material includes covering the portion of the door track with a thermoplastic material, and wherein overlaying a portion of the first insulating material with a second insulating material includes overlaying the portion of the first insulating material with a metallic material.

21. The method of claim 18 wherein the door track is mounted to a door jamb extending along an edge of the door opening, and wherein the method further comprises installing a seal between the first insulating material and the door jamb from proximate the lower portion of the door opening to proximate the upper portion of the door opening.

* * * * *

UNITED STATES PATENT AND TRADEMARK OFFICE

CERTIFICATE OF CORRECTION

PATENT NO. : 8,490,669 B2
APPLICATION NO. : 13/398012
DATED : July 23, 2013
INVENTOR(S) : Fletcher et al.

It is certified that error appears in the above-identified patent and that said Letters Patent is hereby corrected as shown below:

In the Claims:

In column 8, claim number 8, line number 34, replace “guide track; and” with “guide channel; and”

Signed and Sealed this
Twenty-second Day of April, 2014

Michelle K. Lee

Michelle K. Lee
*Deputy Director of the United States Patent and Trademark Office*